US008671603B2

(12) United States Patent
Garfinkle

(10) Patent No.: US 8,671,603 B2
(45) Date of Patent: Mar. 18, 2014

(54) DECORATIVE AND INFORMATIVE SIGNAGE

(76) Inventor: Benjamin Garfinkle, Piedmont, CA (US)

( * ) Notice: Subject to any disclaimer, the term of this patent is extended or adjusted under 35 U.S.C. 154(b) by 629 days.

(21) Appl. No.: 11/936,942

(22) Filed: Nov. 8, 2007

(65) Prior Publication Data

US 2008/0295373 A1 Dec. 4, 2008

Related U.S. Application Data

(63) Continuation of application No. 11/412,514, filed on Apr. 27, 2006.

(51) Int. Cl.
*G09F 3/18* (2006.01)

(52) U.S. Cl.
USPC ..... 40/649; 40/661

(58) Field of Classification Search
USPC ..... 40/642.02, 649, 661, 606.01, 606.19, 40/611.06, 611.08, 745, 765, 768, 771
See application file for complete search history.

(56) References Cited

U.S. PATENT DOCUMENTS

| | | | | | |
|---|---|---|---|---|---|
| 1,822,492 | A * | 9/1931 | Lamb | 40/611.05 |
| 2,259,272 | A * | 10/1941 | Sholkin et al. | 40/611.05 |
| 2,297,574 | A * | 9/1942 | McCord | 40/606.19 |
| 4,593,486 | A * | 6/1986 | Visocky et al. | 40/490 |
| 6,266,905 | B1 * | 7/2001 | Forsythe et al. | 40/657 |
| 6,269,572 | B1 * | 8/2001 | Forsythe et al. | 40/657 |
| 6,505,428 | B1 * | 1/2003 | Williams-King et al. | 40/661 |
| 6,581,316 | B2 * | 6/2003 | Forsythe et al. | 40/657 |
| 2005/0072033 | A1 * | 4/2005 | Nathanson et al. | 40/661 |
| 2006/0162213 | A1 * | 7/2006 | Einarson | 40/765 |

* cited by examiner

*Primary Examiner* — Gary Hoge
(74) *Attorney, Agent, or Firm* — Bay Area Technology Law Group PC

(57) ABSTRACT

A sign system for displaying product information proximate a product being vended. The sign system includes a support for maintaining a sign system at a predetermined orientation. A substantially planar face is appended to the support having a front surface and a rear surface. A primary sign is releaseably retained to the front surface of the planar face, the primary sign having an opening or window therein. At least one channel is configured to the front or rear surface of the planar face and positioned substantially behind the opening or window of the primary sign. A secondary sign is releaseably retained within the channel such that at least a portion of the secondary sign is visible through the opening or window in the primary sign.

7 Claims, 6 Drawing Sheets

DECORATIVE AND INFORMATIVE SIGNAGE

RELATED APPLICATIONS

The present application is a continuation-in-part of U.S. patent application Ser. No. 11/412,514, filed on Apr. 27, 2006.

TECHNICAL FIELD

A sign system for displaying product information proximate a product being vended. The sign system includes a support for maintaining a sign system at a predetermined orientation. A substantially planar face is appended to the support having a front surface and a rear surface. A primary sign is releaseably retained to the front surface of the planar face, the primary sign having an opening or window therein. At least one channel is configured preferably to the rear surface of the planar face and positioned substantially behind the opening of the primary sign. A secondary sign is releaseably retained within the channel such that at least a portion of the secondary sign is visible through the opening or window in the primary sign.

BACKGROUND OF THE INVENTION

Retail establishments such as food markets vend upwards of thousands of items displayed on shelves and in display cases. Retail establishments carrying such products must not only be able to track them but must also be able to display them in conjunction with signage that is attractive and capable of differentiating brands or manufacturers.

Most grocery stores and food markets employ a computerized tracking system to enable a merchant to determine which products are successfully being purchased and which remain on store shelves. This information is critical to enable a vendor to maximize profitability by eliminating from store shelves those products which are not being purchased while enabling the vendor to efficiently reorder those products which its data system indicates are successful and thus being depleted in inventory. In this regard, reference is made to FIG. 1.

FIG. 1 depicts signage 10 which later will be referred to as a "secondary sign." Signage 10 contains a good deal of information which is necessary for product tracking through computerized databases but which detracts from the visually appealing impact which product signage should otherwise embrace. For example, besides pricing information 12, signage 10 also includes a bar code 111 and complimentary serial number information 14. A PLU # is also provided in field 13 together with a statement of the product being tracked, in this case, "ENGLISH STYLE POTATO SALAD." Again, if such signage was to be placed within an easel-based holder in a deli case or along a C-channel situated in a display case, the fact that a certain variety of potato salad is being sold at 0.99 per pound would at worst be lost in the background information displayed on the signage, or, at best, would not represent a visually impactful sign likely to attract a retail customer.

In addition to the desire to obfuscate a number of fields of signage 10, retailers have recognized that providing signage which is attractive as well as informative and stimulating is most likely to have the desired effect of promoting product sales. However, signage 10 is simply too small and crowded to enable a retailer to add any additional customer stimulating or attracting information thereto. This is not surprising considering that signage 10 was designed for placement on the edge of a shelf, positioned for a consumer to have very close eye contact. However, such signage, in and of itself, is not particularly appropriate for highly stylized easel displays and the like where the viewing distance is increased.

It is thus an object of the present invention to provide signage which informs and attracts customers while taking advantage of product tracking information necessary for internal inventorying of goods.

This and further objects will be more readily appreciated when considering the following disclosure and appended claims.

SUMMARY OF THE INVENTION

The present invention is directed to a sign system for displaying product information proximate a product being vended, said sign system comprising a support for maintaining said sign system in a predetermined orientation, a substantially planar face appended to said support and having a front surface and a rear surface, a primary sign releaseably retained to said front, said sign having an opening or window through which information contained on a secondary sign can be seen. At least one channel is configured to the front or back planar surface and positioned substantially behind said opening or window in said primary sign. A secondary sign is releaseably retained within said channel such that at least a portion of said secondary sign is visible through said opening or window.

DETAILED DESCRIPTION OF THE INVENTION

Figure 3:
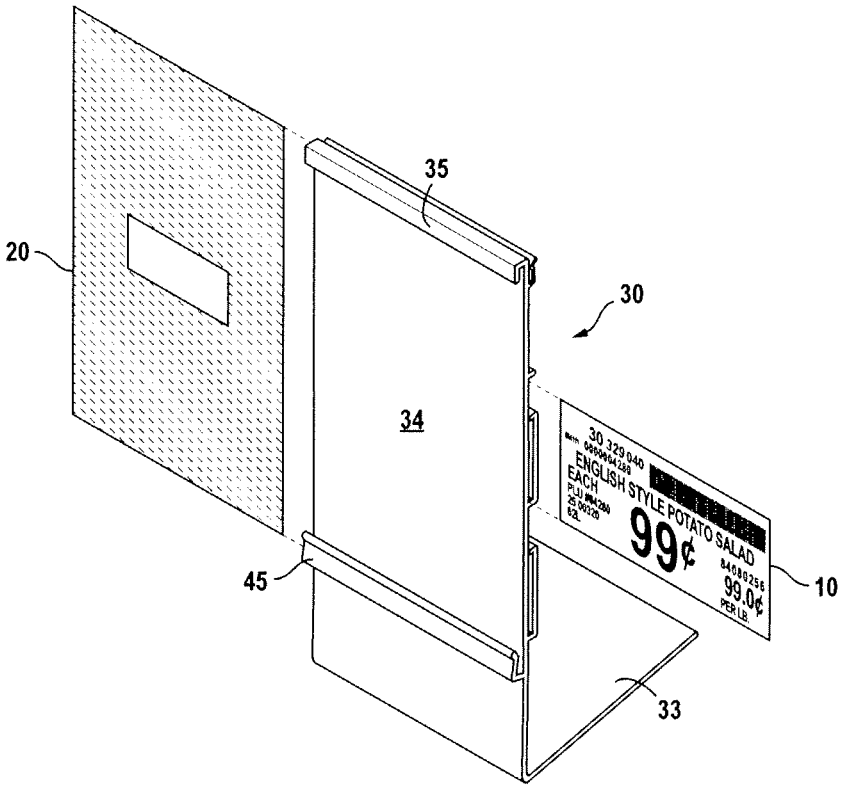
FIG. 3 is a perspective view showing how the various elements of the present invention would be joined in creating the signage sought after herein.
Figure 4:
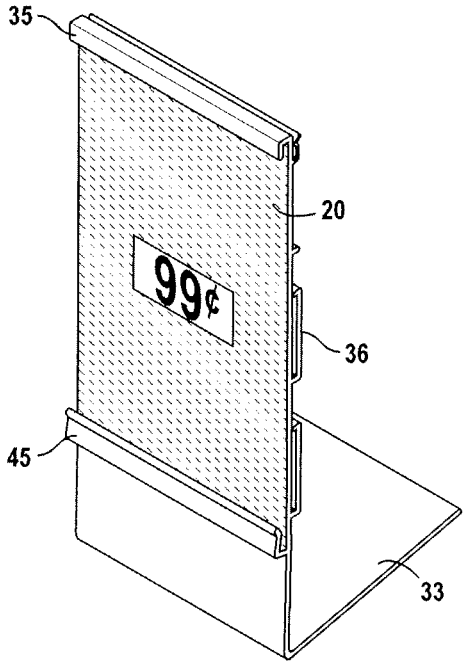
FIG. 4 is a perspective view of the signage of FIG. 3 once assembled.

Turning first to FIGS. 3 and 4, sign system 30 is depicted Such sign system includes support 33 for maintaining said sign system at a predetermined orientation. Support 33 can be an easel base and it can be, as depicted, an element injection molded or extruded with planar face 34 to constitute a single part. As noted, when base 33 is placed upon a horizontal surface, planar face 34 extends preferably at a slight angle from vertical towards the anticipated line of sight of a consumer.

Figure 1:
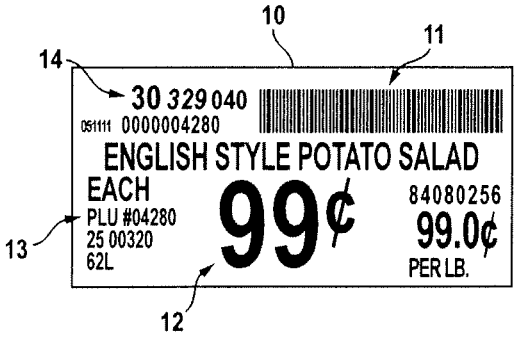
FIG. 1 (PRIOR ART)
FIG. 1 is a front plan view of inventory signage typical of the prior art.
Figure 2A:
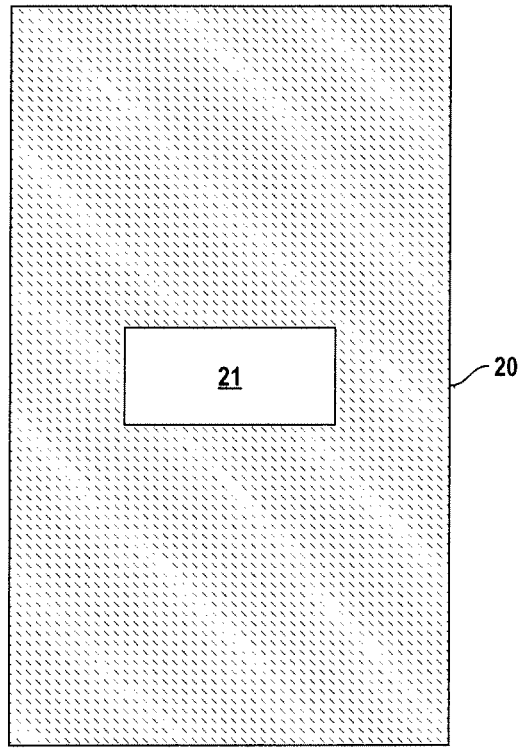
FIGS. 2A, 2B and 2C are front plan views of typical primary signage for use in carrying out the present invention.
Figure 2B:
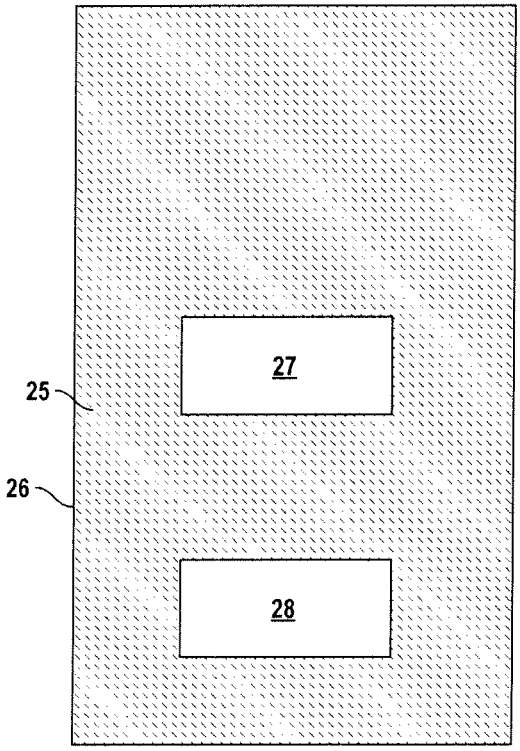
Figure 2C:
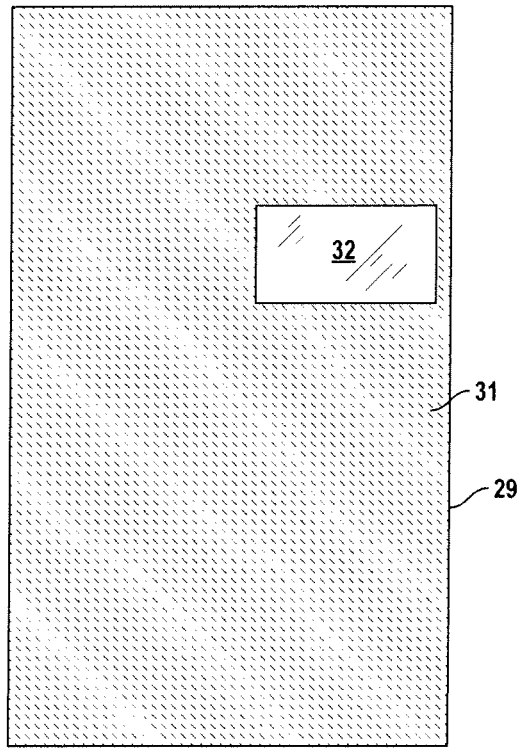

Although primary sign 20 is shown without graphics or product identifying information, such information would, when commercially employed, be applied to the front face of sign 20 in field 21. It should be noted that the relative size of sign 20 with respect to secondary sign 10 enables a retailer to place a relatively large amount of graphical and informative information thereupon to both attract a retail customer and provide information such as whether the product being sold is "organic," "fresh," etc. Although primary sign 20 of FIGS. 2A and 3 is typical of its configuration in practicing the present invention, other iterations are certainly possible while remaining within the spirit and scope of the present invention. For example, FIG. 2B shows primary signage 25 wherein two openings or windows 27 and 28 are provided within field 26 while FIG. 2C shows signage 29 provided with opening or window 32 within field 31.

Turning once again to FIGS. 3 and 4, in use, primary sign 20 is shown releaseably retained on the front surface of planar face 34. Ideally, primary sign 20 is sized such that ribs 35 and 45 are spaced apart from one another to frictionally capture and releaseably retain signage 20 on the front surface of planar face 34 at surface 53.

Figure 9:
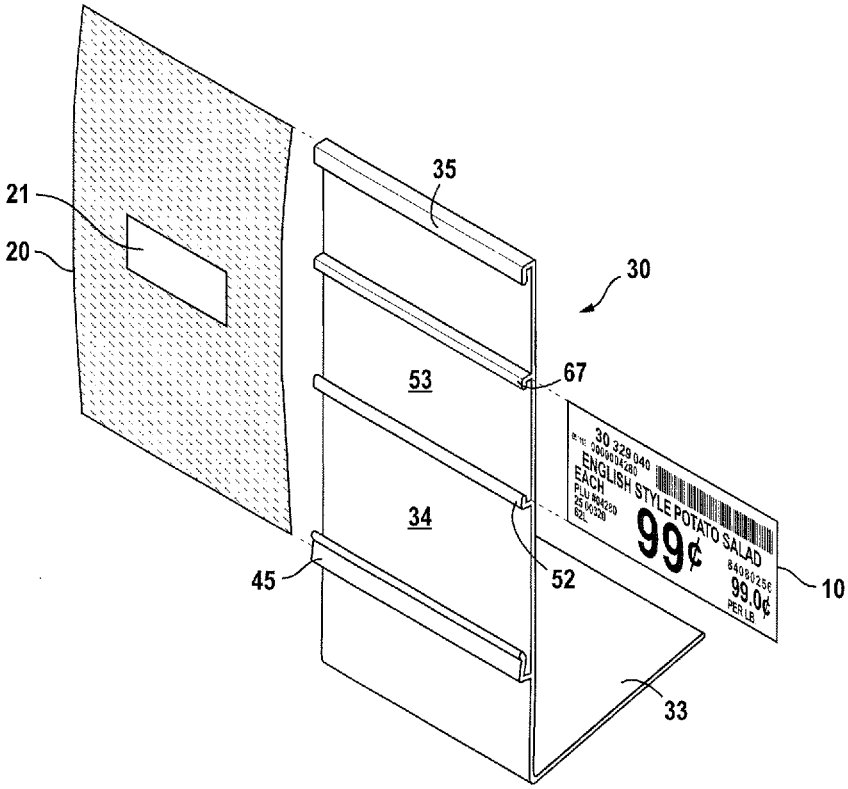
FIG. 9 is a perspective view of a variation of the signage used to carry out the present invention.

To complete signage 30, secondary sign 10 is shown being capable of being releaseably captured by channel 36, itself being located on either the rear or front surfaces of planar face 34. As shown in FIGS. 3 and 4, multiple channels 36 can be provided when employing, for example, primary sign 25 having two openings or windows 27 and 28. Secondary sign 10 can be placed in front of the front surface of planar face 34 and this is depicted in FIG. 9. In doing so, secondary sign 10 is slid within ribs 67 and 52 in order to position information to be read by a consumer behind signage 20 and visible through window 21.

It is noted in comparing FIGS. 1, 3, 4 and 9 that when secondary signage 10 is placed within channels 36 and behind primary sign 20, only the price of the product, in this case, 99¢, is visible to a consumer. All of the miscellaneous and detracting fields 11, 13, etc., have now been blocked from view by primary sign 20 and its strategically sized opening or window 22. Information such as the product being "English Style Potato Salad" can be instead, artfully depicted on primary sign 20 while, in doing so, the product tracking and inventorying information contained on secondary sign 10 remains associated with the product for internal use by the retailer. It should be noted, however, that other secondary signage can be employed, such as original signage having nothing more than information imprinted thereon.

Although the embodiment of the present invention shown in FIGS. 3, 4 and 9 depict a support and planar face as a single continuous part such as one which has been injection molded from clear plastic, the present invention also encompasses those embodiments shown in FIGS. 5 through 8 and 10 through 14.

Figure 5:
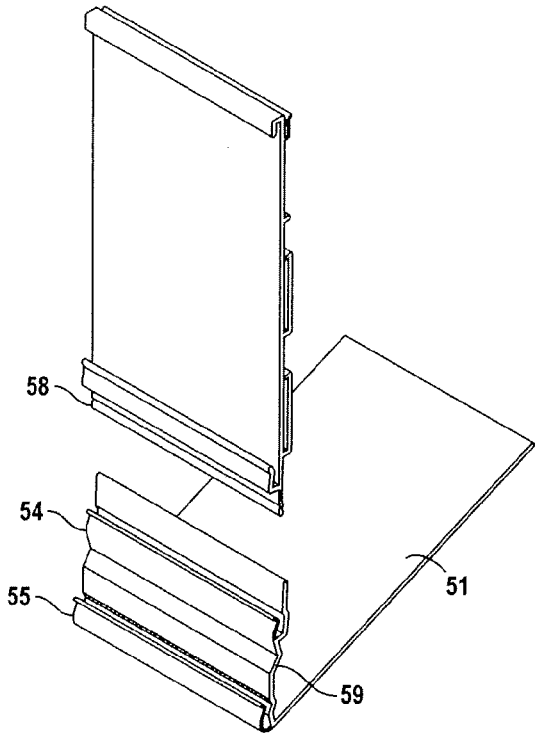
FIG. 5 is a perspective view of a second embodiment to the present invention.
Figure 6A:
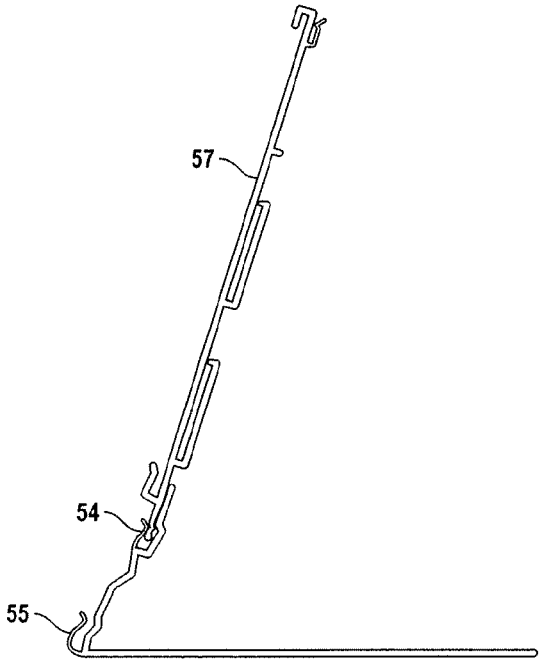
FIGS. 6A and 6B are side views of the embodiment shown in FIG. 5 depicting two possible orientations of this assembly.
Figure 6B:
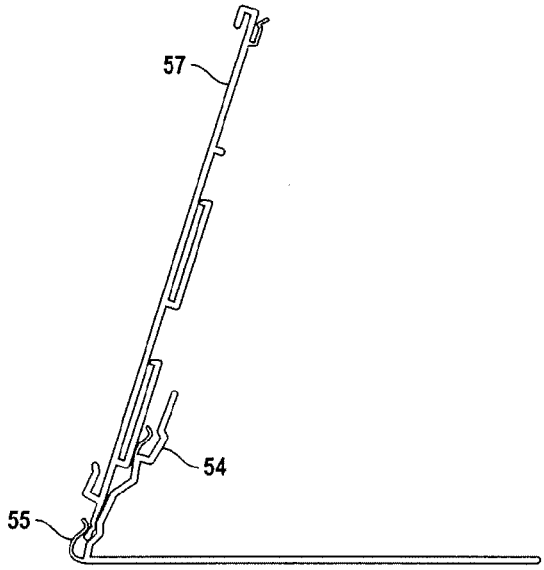
Figure 7:
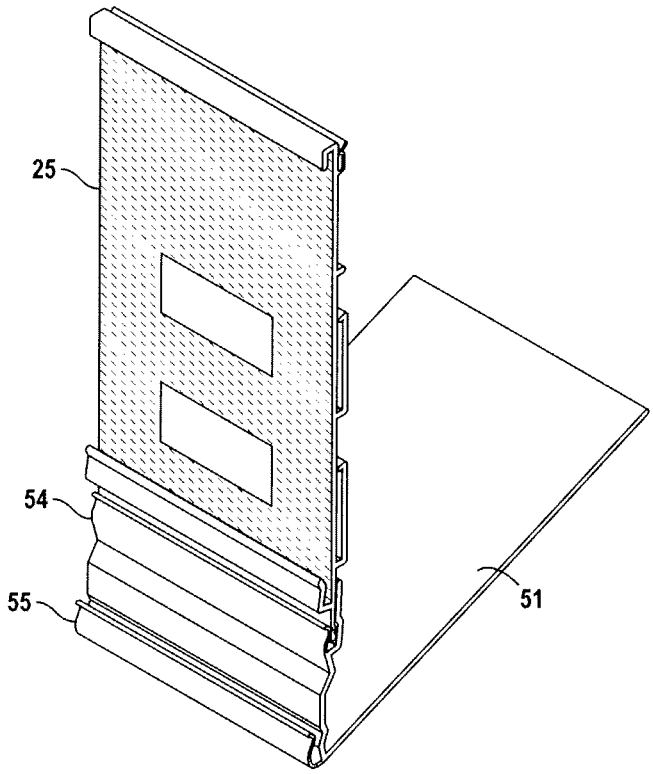
FIGS. 7 and 8 are perspective views showing signage corresponding to the present signage oriented as shown in FIGS. 6A and 6B, respectively.
Figure 8:
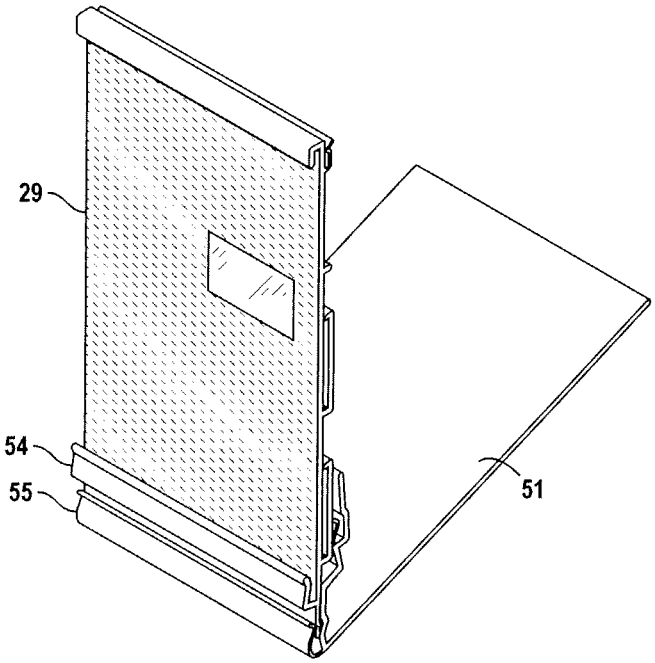

Turning to FIG. 5, easel support 51 is shown having an upturned section 59 intended to rest upon a shelf or flat surface in a display case. Continuing with the embodiment shown in FIG. 5, upturned section 59 includes clip channels 54 and 55 sized to receive a corresponding rail 58. In comparing FIGS. 6A and 6B, it is noted that the height of planar face 57 can be varied depending upon which clip channel 54 or 55 is used to engage rail 58. In doing so, one could achieve either embodiment shown in FIGS. 7 and 8, FIG. 7 corresponding to engagement shown in FIG. 6A while FIG. 8 depicts the engagement shown in FIG. 6B. Alternative primary signage such as that shown in FIG. 2B is illustrated as being supported in the embodiment of FIG. 7 while the primary sign of FIG. 2C is shown installed in the embodiment of FIG. 8. These illustrations are merely made to further highlight the flexibility of the present invention.

As noted previously, although the prior discussion is focused upon a signage system employing an easel support, such a restriction is not at all necessary in employing this invention in various environments where such signage would be beneficial. In this regard, reference is next made to FIG. 10.

Figure 10:
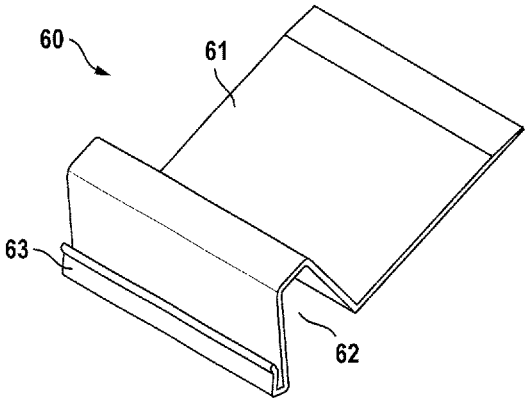
FIGS. 10 through 14 are perspective views of various supports which can be employed, depending upon the environment in which the sign is intended to occupy in a typical retail establishment.

FIG. 10 depicts modified easel support 60 having a planar section 61 and a U-shaped rise 62. In providing rise 62, modified easel support 60 is capable of supporting the appropriate signage holder appended to modified easel support 60 through clip channel 63 enabling it to clear the lip of tray.

Figure 11:
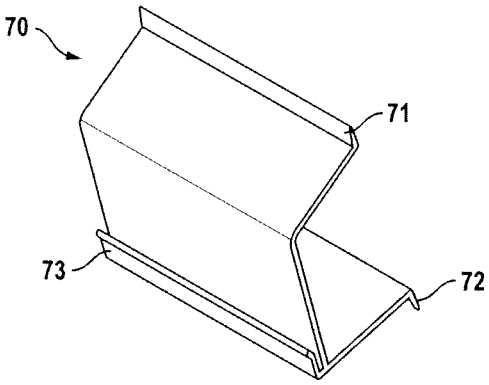

FIG. 11 depicts yet another support for this signage, in this instance, molding clip 70 which is provided with outturned ridges 71 and 72 for being captured by a typical tag molding channel. Once in place, the signage of the present invention can be captured by clip channel 73.

Figure 12:
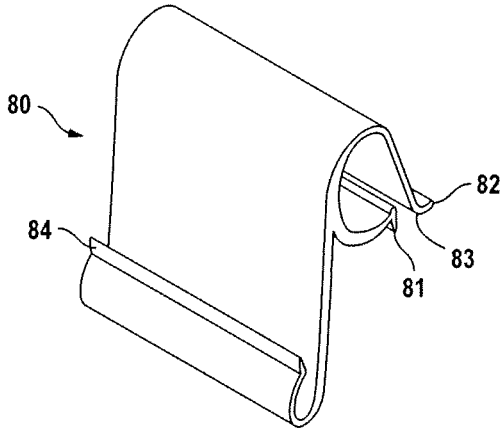
Figure 13:
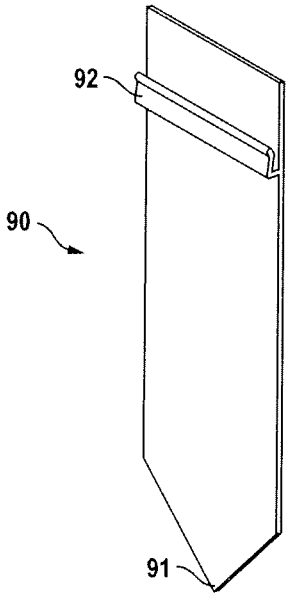
Figure 14:
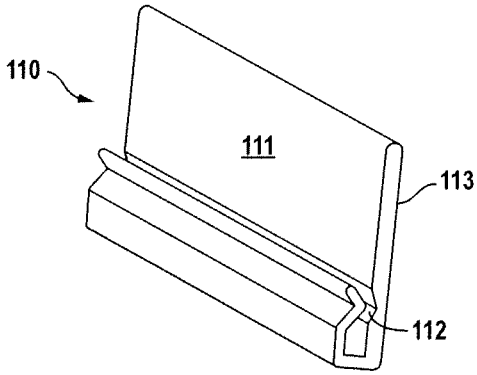

FIG. 12 depicts clip 80 containing outturned elements 81 and 82 and channel region 83 enabling clip 80 to append to a variety of in-store articles such as wire racks, wicker baskets, bakery trays and crocks. Once having done so, the signage of the present invention can be received and releaseably retained by clip channel 84.

Additionally, support 90 can be employed which is intended to be physically inserted into ice at penetrating tip 91. Once having done so, clip channel 92 can be used to support the signage of the present invention.

Finally, reference is made to support 110. This support includes vertically extending face 111 and clip channel 1112, the later capable of receiving signage such as depicted by rail 58 and planar face 57 (FIG. 5). It is contemplated that support 110 be employed with foam tape used on back 113 of vertically extending face 111 and placed on the edge of a shelf as it is recognized that some deli case shelves do not have tag moldings that could be employed to engage other embodiments as previously described.

The invention claimed is:

1. A sign system for displaying product information on sheet material proximate a product being vended, said sign system comprising a support for maintaining said sign system in a predetermined orientation, a substantially planar face appended to said support and having a front surface and rear surface and at least one unitary channel formed on said front or rear surface, a primary sign in the form of sheet material releasably retained thereto, said primary sign having an opening or window and a secondary sign in form of sheet material releasably retained within at least one of said unitary channels such that at least a portion of said secondary sign is visible through said opening or window, said support being provided with a plurality of clip channels, each extending substantially parallel to one another and each releasably receiving said planar face.

2. A sign system for displaying product information on sheet material proximate a product being vended, said sign system comprising a support for maintaining said sign system in a predetermined orientation, a substantially planar face appended to said support and having a front surface and rear surface, and at least one unitary channel formed on said front or rear surface, a primary sign in the form of sheet material releasably retained thereto, said primary sign having an opening or window and a secondary sign in the form of sheet material releasably retained within at least one of said unitary channels such that at least a portion of said secondary sign is visible through said opening or window, and wherein said substantially planar face is transparent.

3. The sign system of claim 2 wherein a pair of retaining ribs are configured on said planar face for releasably retaining and maintaining said primary sign.

4. The sign system of claim 2 wherein said opening or window in said primary sign is sized to enable a portion, but not all, of said secondary sign to be visible therethrough.

5. The sign system of claim 2 wherein said support is an easel base.

6. The sign system of claim 4 wherein said support and planar face are extended as a single element.

7. The sign system of claim 2 wherein said primary sign is provided with a plurality of openings or windows configured herein.

* * * * *